US011110620B2

(12) United States Patent
Park et al.

(10) Patent No.: US 11,110,620 B2
(45) Date of Patent: Sep. 7, 2021

(54) RAZOR CARTRIDGE AND RAZOR CARTRIDGE ASSEMBLY HAVING SEATING PROTRUSIONS OF DIFFERENT HEIGHTS TO SEAT AT LEAST ONE RAZOR BLADE

(71) Applicant: DORCO CO., LTD., Seoul (KR)

(72) Inventors: Semin Park, Seoul (KR); Byungsun Ahn, Seoul (KR)

(73) Assignee: DORCO CO., LTD, Seoul (KR)

( * ) Notice: Subject to any disclaimer, the term of this patent is extended or adjusted under 35 U.S.C. 154(b) by 0 days.

(21) Appl. No.: 16/203,318

(22) Filed: Nov. 28, 2018

(65) Prior Publication Data

US 2019/0160699 A1 May 30, 2019

(30) Foreign Application Priority Data

Nov. 29, 2017 (KR) ..... 10-2017-0162040

(51) Int. Cl.
*B26B 21/40* (2006.01)
*B26B 21/22* (2006.01)

(52) U.S. Cl.
CPC ..... *B26B 21/4025* (2013.01); *B26B 21/222* (2013.01); *B26B 21/4012* (2013.01); (Continued)

(58) Field of Classification Search
CPC ..... B26B 21/4025; B26B 21/222; B26B 21/4012; B26B 21/4018; B26B 21/4031; B26B 21/4075
See application file for complete search history.

(56) References Cited

U.S. PATENT DOCUMENTS 3,783,510 A * 1/1974 Dawidowicz ..... B26B 21/222 30/47
3,842,502 A * 10/1974 Hagan ..... B26B 21/54 30/346.58

(Continued)

FOREIGN PATENT DOCUMENTS

CN 101472717 7/2009
EP 0064190 11/1982

(Continued)

OTHER PUBLICATIONS

European Patent Office Application Serial No. 18209138.9, Search Report dated Apr. 18, 2019, 9 pages.

(Continued)

*Primary Examiner* — Ghassem Alie
*Assistant Examiner* — Fernando A Ayala
(74) *Attorney, Agent, or Firm* — Lee, Hong, Degerman, Kang & Waimey

(57) ABSTRACT

Provided is a razor cartridge including at least one razor blade having a cutting edge, a blade housing configured to accommodate the at least one razor blade, a guard bar disposed at a front portion of the blade housing, and a cap disposed at a rear portion of the blade housing, wherein the blade housing includes at least one support member configured to connect the front portion and the rear portion, a plurality of seating protrusions disposed on the at least one support member and configured to seat the at least one razor blade, and the plurality of seating protrusions include a first seating protrusion having a first height and a second seating protrusion having a second height lower than the first height.

21 Claims, 16 Drawing Sheets

(52) U.S. Cl.
CPC ..... *B26B 21/4018* (2013.01); *B26B 21/4031* (2013.01); *B26B 21/4075* (2013.01)

(56) References Cited

U.S. PATENT DOCUMENTS

| | | | | |
|---|---|---|---|---|
| 3,909,942 | A * | 10/1975 | Ciaffone | B26B 21/4018 30/47 |
| 4,389,773 | A | 6/1983 | Nissen et al. | |
| 4,866,844 | A * | 9/1989 | Burout, III | B26B 21/22 30/50 |
| 5,313,706 | A * | 5/1994 | Motta | B26B 21/227 30/47 |
| 5,456,009 | A * | 10/1995 | Wexler | B26B 21/22 30/77 |
| 5,590,468 | A * | 1/1997 | Prochaska | B26B 21/22 30/41 |
| 5,630,275 | A * | 5/1997 | Wexler | B26B 21/22 30/346.53 |
| 5,687,485 | A | 11/1997 | Shurtleff et al. | |
| 5,761,814 | A | 6/1998 | Anderson et al. | |
| 5,822,862 | A * | 10/1998 | Ferraro | B26B 21/227 30/50 |
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,161,288 | A * | 12/2000 | Andrews | B26B 21/00 30/50 |
| 6,185,822 | B1 | 2/2001 | Tseng et al. | |
| 6,212,777 | B1 | 4/2001 | Gilder et al. | |
| 6,430,818 | B1 * | 8/2002 | Wonderley | B26B 21/222 30/346.57 |
| 6,442,839 | B1 | 9/2002 | Tseng et al. | |
| 6,473,970 | B1 * | 11/2002 | Prochaska | B26B 21/222 30/41 |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 7,100,284 | B2 | 9/2006 | King | |
| 9,604,373 | B2 * | 3/2017 | Park | B26B 21/4012 |
| 2011/0308089 | A1 | 12/2011 | Bridges | |
| 2014/0026424 | A1 | 1/2014 | Oglesby et al. | |
| 2015/0090085 | A1 | 4/2015 | Griffen et al. | |
| 2018/0264668 | A1 | 9/2018 | Kim et al. | |

FOREIGN PATENT DOCUMENTS

| | | |
|---|---|---|
| EP | 1046473 | 10/2000 |
| EP | 2823941 | 1/2015 |
| JP | S584588 | 1/1983 |
| JP | H09511667 | 11/1997 |
| JP | H10263220 | 10/1998 |
| JP | 2002510235 | 4/2002 |
| JP | 2009540885 | 11/2009 |
| JP | 2011520554 | 7/2011 |
| JP | 2014527453 | 10/2014 |
| KR | 101668230 | 10/2016 |
| WO | 9916592 | 4/1999 |
| WO | 2007147420 | 12/2007 |
| WO | 2016153798 | 9/2016 |
| WO | 2017086514 | 5/2017 |

OTHER PUBLICATIONS

Japan Patent Office Application No. 2018-223403, Office Action dated Apr. 28, 2020, 6 pages.

The State Intellectual Property Office of the People's Republic of China Application Serial No. 201811352090.5, Office Action dated Jan. 7, 2021, 6 pages.

* cited by examiner

RAZOR CARTRIDGE AND RAZOR CARTRIDGE ASSEMBLY HAVING SEATING PROTRUSIONS OF DIFFERENT HEIGHTS TO SEAT AT LEAST ONE RAZOR BLADE

Pursuant to 35 U.S.C. § 119(a), this application claims the benefit of earlier filing date and right of priority to Korean Patent Application No. 10-2017-0162040, filed on Nov. 29, 2017, the contents of which are all hereby incorporated by reference herein in its entirety.

BACKGROUND

1. Field of the Disclosure

The present disclosure relates to a razor cartridge, and more particularly, to a razor cartridge and razor cartridge assembly having seating protrusions for more firmly seating a plurality of razor blades on a blade housing.

2. Description of the Related Art

Generally, a conventional razor, which is known as a wet razor, includes a razor cartridge and a razor handle. Generally, the razor cartridge includes at least one blade disposed between a rear side of a guard bar and a front side of a cap and includes a blade housing for seating the blade. The razor cartridge is installed to be detachable from and pivotable on the razor handle so that the razor cartridge is able to pivot with respect to the razor handle, between a neutral position and a pivot position during use of the razor. Generally, such pivoting motion is basically performed about a rotation axis that is parallel to a direction in which the razor blade is disposed on the blade housing. In this way, since the razor cartridge is detachably disposed on the razor handle, the user may remove a razor cartridge whose razor blade has become dull to some extent and mount a new razor cartridge on the razor handle for use when shaving afterwards.

However, in recent years, the number of blades mounted on a blade housing has been increasing, and in order to mount a plurality of blades on a narrow blade housing, a span between blades also has to be reduced corresponding to the narrow blade housing. In addition, accordingly, the size of seating portions for seating the plurality of blades on the blade housing also has to be reduced.

To address the reduction in blade housing size, a razor having a corrugated protrusion has been proposed. According to this razor, sludge discharge is possible between blades, and the blades may be stably fixed. However, in a case in which, due to a narrow span between blades, protrusions corresponding thereto have to be formed at narrow intervals, it may be difficult to form the protrusions by injection molding, and even if injection molding is possible, high accuracy is required in a subsequent assembling process due to the narrow intervals between the protrusions. In addition, it may be difficult for the protrusions formed by injection molding to firmly support the plurality of blades.

Therefore, there is a need to devise a blade seating portion, which has a structure capable of stably storing and keeping razor blades which have a narrow span therebetween or have a relatively thin base portion, and a razor cartridge including the same.

SUMMARY

Aspects of the present disclosure provide a razor cartridge having seating protrusions for stably supporting blades on a blade housing.

Aspects of the present disclosure also provide a razor cartridge having a structure in which injection of a support member for supporting blades on a blade housing and a seating protrusion formed on the support member is facilitated.

Aspects of the present disclosure also provide a razor cartridge assembly including a connector that is able to be promptly and easily assembled to a blade housing.

It should be noted that objects of the present disclosure are not limited to the above-described objects, and other objects of the present disclosure will be apparent to those skilled in the art from the following descriptions.

To achieve the above objects, a razor cartridge according to an embodiment of the present disclosure includes at least one razor blade having a cutting edge, a blade housing configured to accommodate the at least one razor blade, a guard disposed at a front portion of the blade housing, and a cap disposed at a rear portion of the blade housing, wherein the blade housing includes at least one support member configured to connect the front portion and the rear portion, a plurality of seating protrusions disposed on the support member and configured to seat the at least one razor blade, and the plurality of seating protrusions include a first seating protrusion having a first height and a second seating protrusion having a second height lower than the first height wherein the second seating protrusion is positioned closer to the rear portion of the blade housing than the first seating protrusion.

To achieve the above objects, a razor cartridge assembly according to an embodiment of the present disclosure includes at least one razor blade having a cutting edge, a blade housing configured to accommodate the at least one razor blade, and a connector coupled to the blade housing at a bottom side of the blade housing and configured to be detachable from a razor handle, wherein the blade housing includes at least one support member disposed perpendicular to a direction in which the at least one razor blade is accommodated, a plurality of seating protrusions disposed on the at least one support member and configured to seat the at least one razor blade, and the plurality of seating protrusions include a first seating protrusion having a first height and a second seating protrusion having a second height lower than the first height.

BRIEF DESCRIPTION OF THE DRAWINGS

The above and other aspects and features of the present disclosure will become more apparent by describing exemplary embodiments thereof in detail with reference to the attached drawings, in which.

DETAILED DESCRIPTION OF THE EMBODIMENTS

Figure 1A:
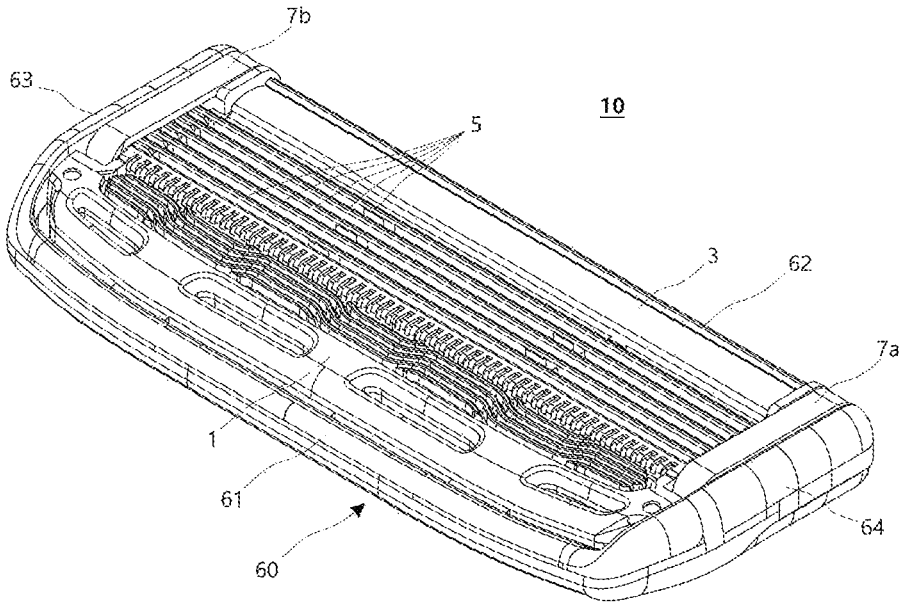
FIGS. 1A to 1D are a perspective view, a plan view, a front view, and a bottom view, respectively, of a razor cartridge according to an embodiment of the present disclosure.

Advantages and features of the present disclosure and a method of achieving the same should become clear with embodiments described in detail below with reference to the accompanying drawings. However, the present disclosure is not limited to embodiments disclosed below and may be realized in various other forms. The present embodiments make the disclosure complete and are provided to completely inform one of ordinary skill in the art to which the present disclosure pertains of the scope of the disclosure. The present disclosure is defined only by the scope of the claims. Like reference numerals refer to like elements throughout.

Unless otherwise defined, all terms including technical and scientific terms used herein have the same meaning as commonly understood by one of ordinary skill in the art to which the present disclosure pertains. Terms, such as those defined in commonly used dictionaries, are not to be construed in an idealized or overly formal sense unless expressly so defined herein.

Terms used herein are for describing the embodiments and are not intended to limit the present disclosure. In the present specification, a singular expression includes a plural expression unless the context clearly indicates otherwise. "Comprises" and/or "comprising" used herein do not preclude the existence or the possibility of adding one or more elements other than those mentioned.

Hereinafter, an embodiment of the present disclosure will be described in detail with reference to the accompanying drawings.

Figure 1B:
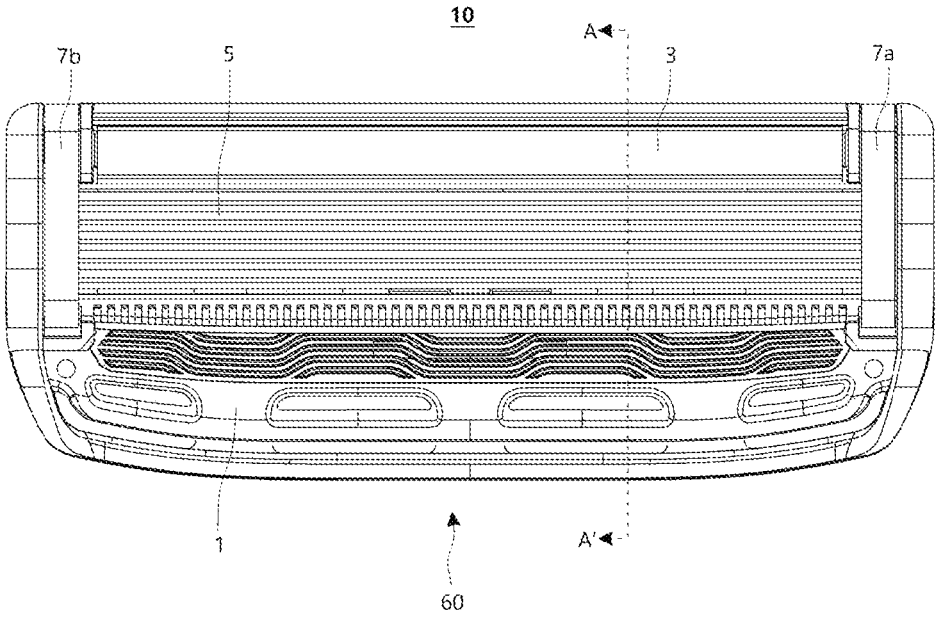
Figure 1C:
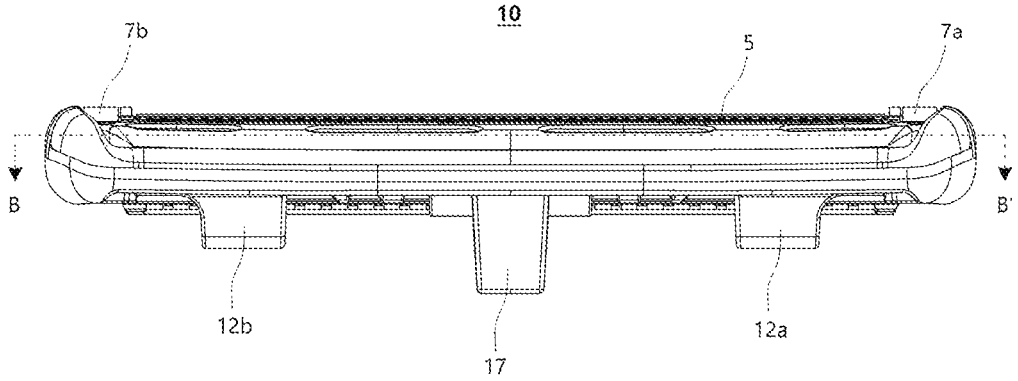
Figure 1D:
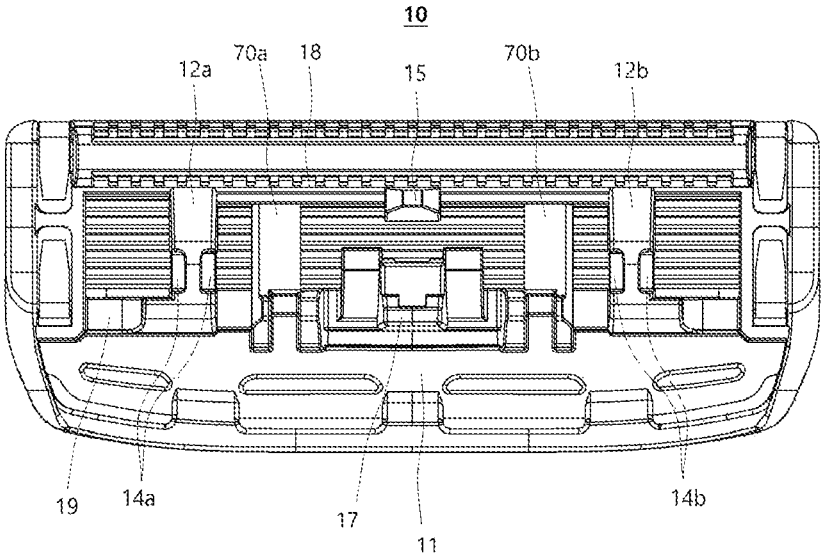

FIG. 1A is a perspective view of a razor cartridge 10 according to an embodiment of the present disclosure, FIG. 1B is a plan view of the razor cartridge 10, FIG. 1C is a front view of the razor cartridge 10, and FIG. 1D is a bottom view of the razor cartridge 10. The razor cartridge 10 may include at least one razor blade 5 having a cutting edge, a blade housing 60 configured to accommodate the at least one razor blade 5, a guard bar 1 disposed at a front portion 61 of the blade housing 60, and a cap 3 disposed at a rear portion 62 of the blade housing. The guard bar 1 causes facial hair of a user to stand upright in a direction that is substantially perpendicular to a shaving direction so that cutting facial hair by the razor blade 5 is facilitated. The guard bar 1 may be manufactured as a firm member or a flexible member. The cap 3 may include a lubrication band as a contact surface that is detached from the skin last during a shaving stroke. The lubrication band serves to soothe irritated skin after the cutting.

The razor blade 5 has a cutting edge at one end, and the other end of the razor blade 5 may be seated on support members 70*a* and 70*b* (see FIG. 3B) included in the blade housing 60. In this case, a single razor blade 5 or two or more razor blades 5 may be disposed, and a direction in which the razor blade 5 is accommodated in the blade housing 60 is a longitudinal direction that is perpendicular to a general shaving direction. Such a razor blade 5 may be formed of stainless steel, ceramic, and/or various other metal materials and may be formed as an integral blade that is integrally formed through a bending process or a large steel blade that is formed by attaching a blade edge portion to an upper portion of a bent support.

Figure 2A:
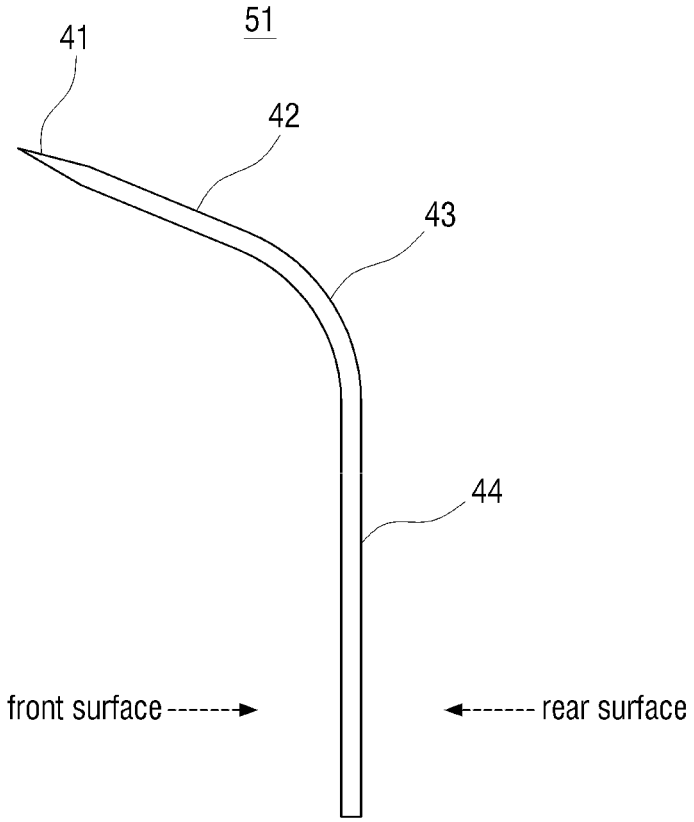
FIGS. 2A and 2B are side views of an integrated blade and a large steel blade, respectively, according to an embodiment of the present disclosure.
Figure 2B:
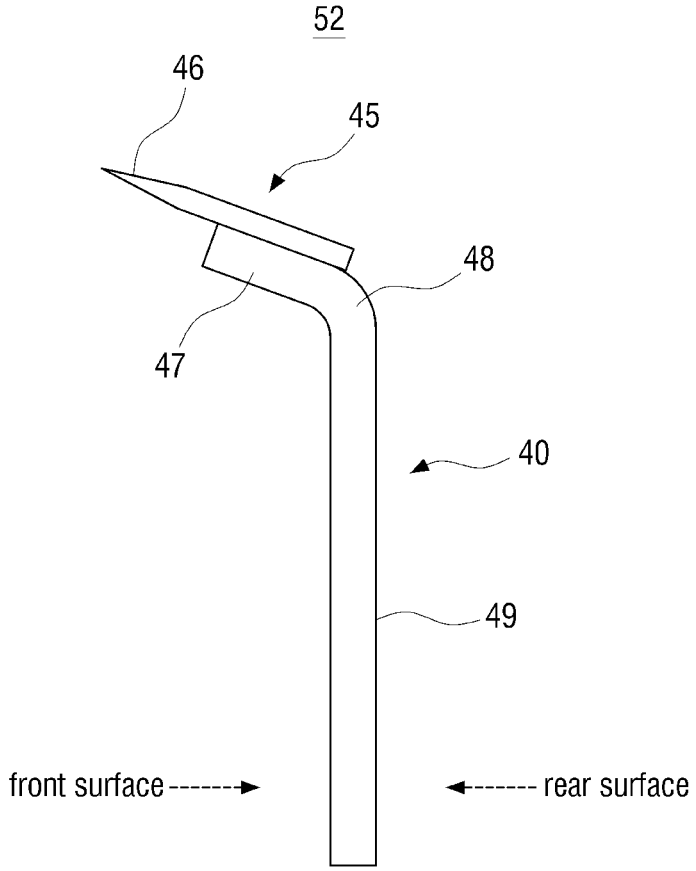

FIG. 2A is a side view illustrating an embodiment of an integrated blade 51, and FIG. 2B is a side view illustrating an embodiment of a large steel blade. Referring to FIG. 2A, the integral blade 51 may include a base portion 44 seated on the support members 70*a* and 70*b* (see FIG. 3B), a cutting portion 42 including a cutting edge 41 at a front end side, and a bent portion 43 that is bent forward and configured to connect the base portion 44 and the cutting portion 42. Such an integral blade 51 may be manufactured using a single body by a bending process and may be designed such that a span between integral blades 51 is relatively narrow and the integral blade 51 has a relatively small thickness.

In another embodiment, as illustrated in FIG. 2B, the large steel blade 52 is formed of two members including a metal support 40 seated on the support members 70*a* and 70*b* (see FIG. 3B) and a cutting portion 45 that is bound to the metal support 40 on the metal support 40 and includes a cutting edge 46. Like the integral blade 51, the metal support 40 includes a base portion 49 and a bent portion 48 and includes a blade attaching portion 47 configured to support and secure the cutting portion 45. Such a metal support 40 of the large steel blade 52 may be formed to be thicker than the cutting portion 45 and may firmly support the cutting portion 45.

Generally, the razor blade 5 may be configured with the above-described integral blade 51 or the large steel blade 52. However, embodiments are not limited thereto, and the razor blade 5 may be configured of any blade such as a straight blade or blades having various other forms as long as the blade has a shaving function.

Meanwhile, in order to prevent detachment of the razor blade 5 from the blade housing 60, a pair of fixing clips 7*a* and 7*b* configured to fix both ends of the cutting edge of the razor blade 5 to the blade housing 60 may be included. The pair of fixing clips 7*a* and 7*b*, positioned at both ends of the razor blade 5, pass through at least one through-hole formed in the vicinity of both ends of the blade housing 60 and may be bent at a bottom surface 11 of the blade housing 60. FIGS. 1A to 1D illustrate an embodiment in which the fixing clips 7*a* and 7*b* are a rear wrap-around type such that the fixing clips 7*a* and 7*b* pass through a through-hole formed in the vicinity of a front end of the blade housing 60 and wrap around a rear end of the blade housing 60.

Referring to the bottom view of the razor cartridge 10 illustrated in FIG. 1D, the blade housing 60 may include, at the bottom surface 11, ribs 12*a* and 12*b* configured to support the blade housing 60 in a direction that is perpendicular to an alignment direction of the razor blade 5. The ribs 12*a* and 12*b* are structures that reinforce the blade housing 60 in a direction across the razor blade 5. The pair of ribs 12*a* and 12*b* may be disposed at left and right sides of the blade housing 60. However, embodiments are not limited thereto, and a greater number of ribs may also be disposed. The ribs 12*a* and 12*b* include guide surfaces 14*a* and 14*b* configured to guide a connector 20 to be easily engaged. At the bottom surface 11 of the blade housing 60, the guide surfaces 14*a* and 14*b* are progressively inclined toward the center of the ribs 12*a* and 12*b*, respectively.

In addition, at the bottom surface 11 of the blade housing 60, a first beam 18 is formed at a portion that is substantially between the razor blade 5 and the cap 3, and the first beam 18 includes a hook coupling portion 15 that is engaged with an elastic hook 23 (see FIG. 9A) of the connector 20. In addition, at the bottom surface 11 of the blade housing 60, a second beam 19 is formed at a portion that is substantially between the guard bar 1 and the razor blade 5, and the second beam 19 includes a central bar 17 that is pushed upon contact with a plunger (not illustrated) of a razor handle 30 when the plunger (not illustrated) protrudes. When the central bar 17 is pushed due to the plunger, the central bar 17 may be elastically deformed, to some extent, in a direction opposite to the plunger.

Meanwhile, the blade housing 60 may include, in addition to the ribs 12*a* and 12*b* or in place of the ribs 12*a* and 12*b*, one or more support members 70*a* and 70*b* configured to connect and support the blade housing 60 in a direction (hereinafter the "transverse direction") that is perpendicular to the direction in which the razor blade 5 is disposed, (hereinafter the "longitudinal direction").

Figure 3A:
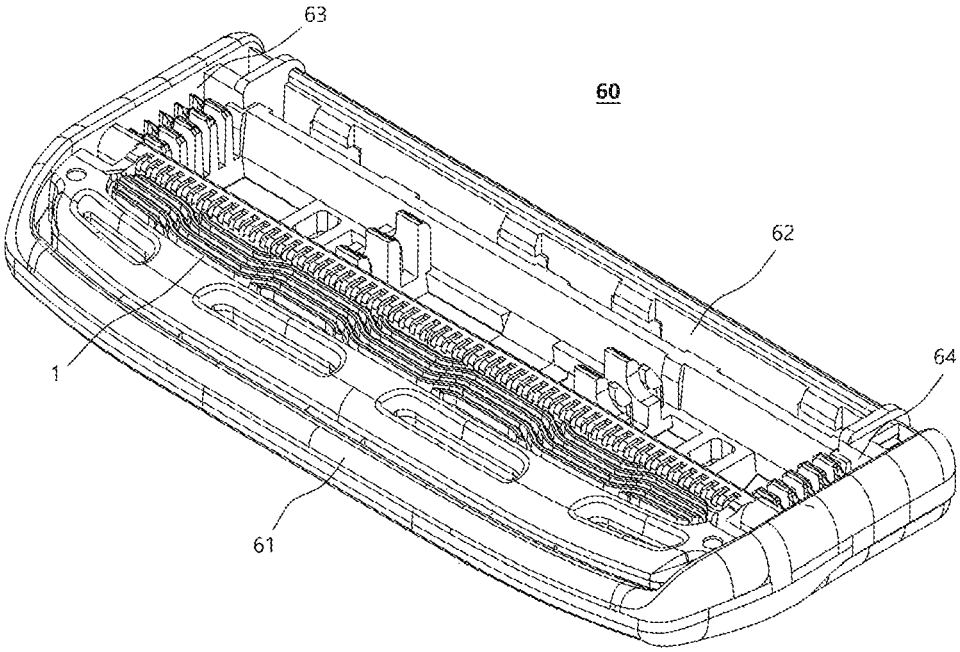
FIGS. 3A and 3B are a perspective view and a plan view, respectively, of a blade housing in a state in which razor blades, a lubrication band, and a fixing clip are removed from a razor cartridge.
Figure 3B:
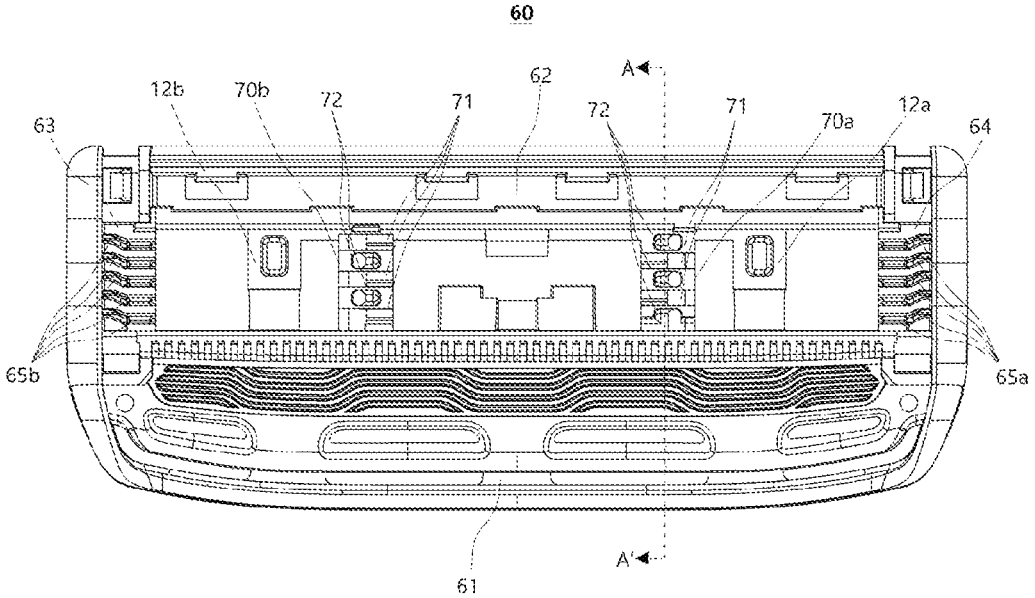

FIGS. 3A and 3B are a perspective view and a plan view, respectively, of the blade housing 60 in a state in which the razor blade 5, a lubrication band 3, and the fixing clips 7*a* and 7*b* are removed from the razor cartridge 10. Here, the guard bar 1 is illustrated as being integrally formed with the blade housing 60, but embodiments are not limited thereto. The guard bar 1 may be separately formed from the blade housing 60 and may be embedded in or assembled to the blade housing 60. In the case in which the guard bar 1 is separately formed as described above, the blade housing 60 may be understood as a portion excluding the guard bar 1 in FIG. 3.

As illustrated in FIGS. 3A and 3B, in some embodiments the blade housing 60 may be basically understood as a quadrilateral frame structure including a front portion 61, a rear portion 62 formed opposite the front portion 61, and a left side portion 63 and a right side portion 64 configured to connect the front portion 61 and the rear portion 62. In addition, the blade housing 60 includes the one or more support members 70*a* and 70*b* configured to connect and support the blade housing 60 in the direction that is perpendicular to the direction in which the razor blade 5 is disposed. In one embodiment, the support members 70*a* and 70*b* connect the front portion 61 and the rear portion 62 of the blade housing 60.

A case in which two support members 70*a* and 70*b* are used is illustrated in FIG. 3B, but embodiments are not limited thereto. The number of support members may be any number that is 1 or greater and that is suitable for seating the razor blade 5.

A plurality of seating protrusions 71 and 72 for seating the at least one razor blade 5 are disposed along the support members 70*a* and 70*b*, e.g., aligned along the transverse direction. In addition to the support members 70*a* and 70*b*, one or more ribs 12*a* and 12*b* configured to reinforce the blade housing 60 may be further included. However, embodiments are not limited thereto, and the ribs 12*a* and 12*b* may be omitted or be integrally formed with the support members 70*a* and 70*b*.

The plurality of seating protrusions 71 and 72 include a first seating protrusion 71 having a first height h1 (see FIG. 4C) and a second seating protrusion 72 having a second height h2 (see FIG. 4C) lower than the first height toward an upper portion of the blade housing 60 (in a direction that is upward in FIG. 3B and is opposite to the razor handle). In this case, the first seating protrusion 71 and the second seating protrusion 72 may be disposed to be parallel on the support members 70*a* and 70*b*. In addition, the first seating protrusion 71 and the second seating protrusion 72 may be alternately disposed on the support members 70*a* and 70*b*.

In addition, a plurality of pressing protrusions 65*a* and 65*b* may be respectively formed at the right side portion 64 and the left side portion 63 of the blade housing 60. Such pressing protrusions 65*a* and 65*b* are also generally referred to as finger portions and press the razor blade 5 due to a stepped structure formed therein. By the pressing, the razor blade 5 is seated on the blade housing 60.

The plurality of razor blades 5 are simultaneously inserted into seating slots formed due to gaps between the first seating protrusion 71 and the second seating protrusion 72 and inserted between the pressing protrusions 65*a* and 65*b*. Therefore, in the embodiment illustrated in FIG. 3B, a single razor blade 5 may be supported at a total of four positions.

FIGS. 4A to 4D are a perspective view, a rear view, a right side view, and a plan view, respectively, of the support member 70*a* disposed at the right of the two support members 70*a* and 70*b*. First, referring to FIGS. 4A to 4C, the first seating protrusion 71 and the second seating protrusion 72 are disposed to be parallel on the support member 70*a*. Particularly, the first seating protrusion 71 and the second seating protrusion 72 are alternately disposed on the support member 70*a*.

In some embodiments, the first seating protrusion 71 includes a front surface 711, a rear surface 712, and an upper surface 713, and a first groove 715 is formed across the upper surface 713 and side surfaces. In this case, the first groove 715 is formed at a corner that faces the outside of the blade housing 60 among corners of the upper surface 713 of the first seating protrusion 71. In addition, an inclined surface 714 is formed from the upper surface 713 toward the rear surface 712 of the first seating protrusion 71.

Figure 6A:
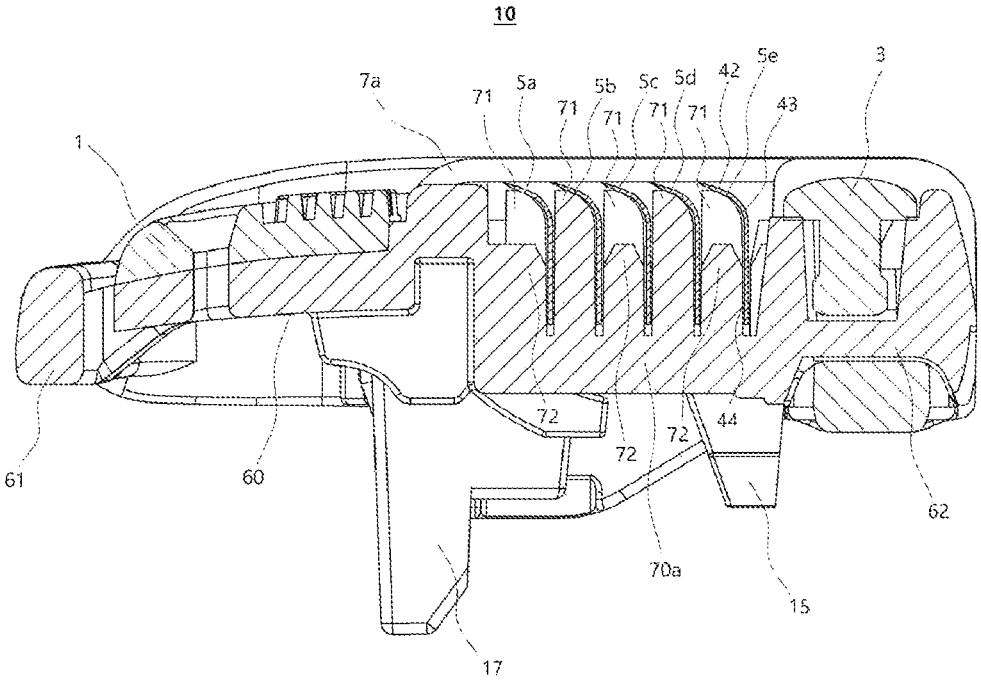
FIG. 6A is a cross-sectional view of the razor cartridge of FIG. 1B taken along line A-A' in FIG. 1B.

Such an inclined surface 714 is an element for supporting the razor blade 5 while coming into contact therewith in a shape similar to an inner surface of the bent portion 43 (see FIG. 6A) of the razor blade 5. For example, the inclined surface 714 may have a round shape having a predetermined curvature. Therefore, as illustrated in FIG. 6A which will be described below, the inclined surface 714 may support at least a portion of a front surface of an integral blade. For example, in the front surface of the integral blade 51 illustrated in FIG. 2A, at least one point of the cutting portion 42 or the bent portion 43 may be supported by the inclined surface 714 of the first seating protrusion 71 or supported by the upper surface 713 of the first seating protrusion 71.

Likewise, in the front surface of the large steel blade 52 illustrated in FIG. 2B, at least one point of the blade attaching portion 47 or the bent portion 48 may be supported by the inclined surface 714 of the first seating protrusion 71 or supported by the upper surface 713 of the first seating protrusion 71.

In some embodiments, the second seating protrusion 72 includes a front surface 721, a rear surface 722, and an upper surface 723, and a second groove 725 is formed across the upper surface 723 and side surfaces. In this case, the second groove 725 is formed at a corner that faces the outside of the blade housing 60 among corners of the upper surface 723 of the second seating protrusion 72. In addition, the second seating protrusion 72 has a tapered surface 724 so as to be progressively tapered toward the upper surface. Such a tapered surface 724 is an element that allows the razor blade 5 to be inserted into a correct position even if there is a slight error in an insertion position when inserting the razor blade 5 between the first seating protrusion 71 and the second seating protrusion 72.

A profile of the first groove 715 of the first seating protrusion 71 and a profile of the second groove 725 of the second seating protrusion 72 may match in the transverse direction. However, embodiments are not limited thereto, and the profile of the first groove 715 and the profile of the second groove 725 may also be different from each other. For example, they may have different sizes or shapes.

Furthermore, the groove 715 may be formed in the first seating protrusion 71 while the groove 725 is not formed in the second seating protrusion 72. This is because, since the size of the second seating protrusion 72 is smaller than that of the first seating protrusion 71, a defect problem is less likely to occur in the second seating protrusion 72 during an injection molding process.

Figure 4A:
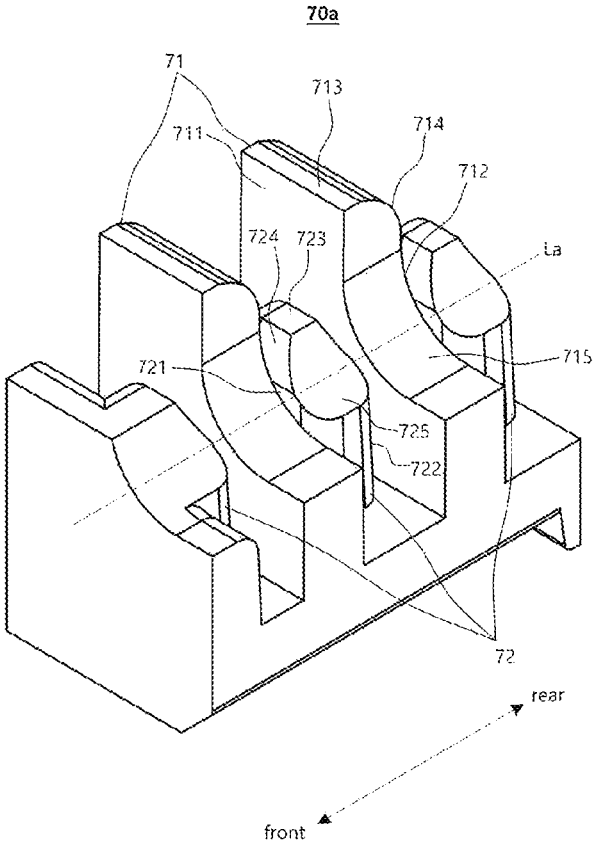
FIGS. 4A, 4B, 4C, and 4D are a perspective view, a rear view, a right side view, and a plan view, respectively, of a support member disposed at the right of two support members.

According to an embodiment, as illustrated in FIG. 4A, the center of the first groove of the first seating protrusion 71 and the center of the second groove of the second seating protrusion 72 are aligned to be parallel along a virtual line La. In this case, the size of the first groove 715 is larger than the size of the second groove 725.

Figure 4B:
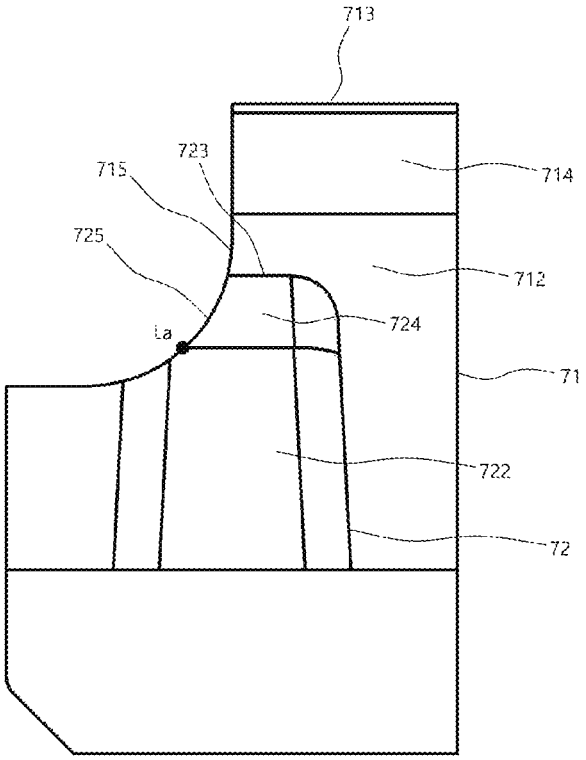

Referring to FIG. 4B illustrating a rear view of the support member 70*a* of FIG. 4A, it can be seen that the profiles of the second groove 725 of the second seating protrusion 72 and the first groove 715 of the first seating protrusion 71 match. In this case, the center of the second groove 725 and the center of the first groove 715 are also collinear with the virtual line La. The reason why the profile of the first groove 715 and the profile of the second groove 725 are formed to match each other is to facilitate withdrawal of a product during injection molding. The grooves 715 and 725 serve as undercuts for withdrawing a product after injection molding when manufacturing the support members 70*a* and 70*b*. The positions of the undercuts may match in the transverse direction.

Figure 4C:
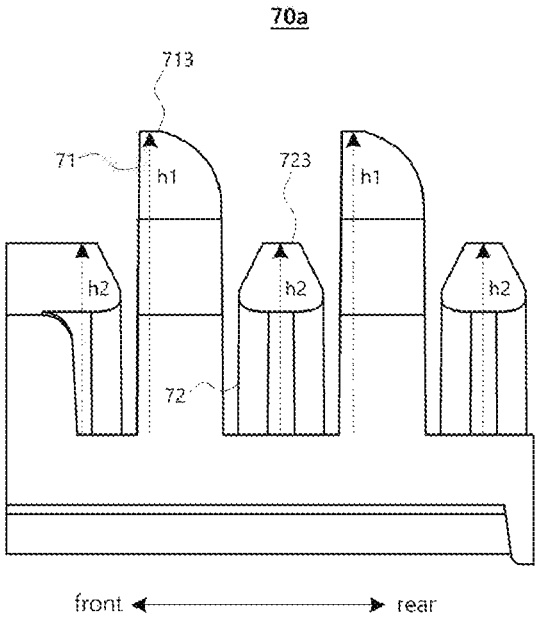
Figure 4D:
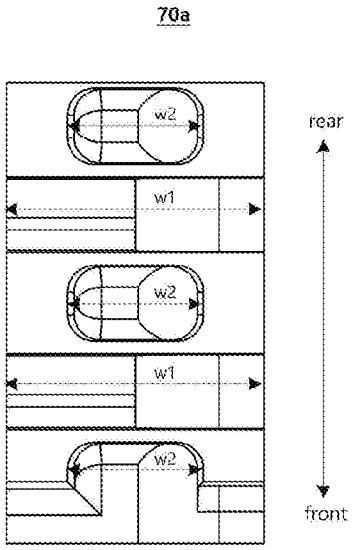

Referring to FIGS. 4C and 4D respectively illustrating the right side view and the plan view of the support member 70*a* of FIG. 4A, the height h2 of the second seating protrusion 72 may be lower than the height h1 of the first seating protrusion 71. In addition, a width w2 of the second seating protrusion 72 may be narrower than a width w1 of the first seating protrusion 71. In some embodiments, the height h1 may be in a range of about 1.5 to 3 mm, and the height h2 may be in a range of about 50 to 70% of the height h1. In addition, the size of the width w1 may be substantially similar to that of the height h1, and the width w2 may be about 45 to 65% of the width w1. As a result, the size of the first seating protrusion 71 may be larger than that of the second seating protrusion 72 as a whole, and a sufficient clearance is secured during injection molding by the first seating protrusion 71, which is relatively larger, and the second seating protrusion 72, which is relatively smaller, being alternately disposed. In this way, an injection failure problem that occurs when manufacturing an injection-molded product having a very narrow and deep groove may be significantly improved.

Figure 5:
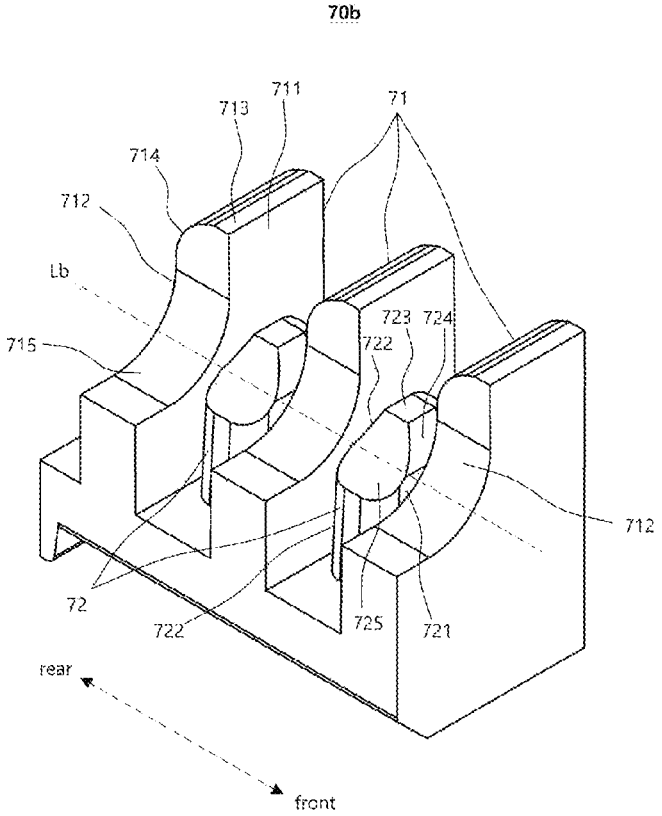
FIG. 5 is a perspective view of a support member disposed at the left of the two support members.

FIG. 5 is a perspective view of an embodiment of the support member 70*b* disposed at the left of the two support members 70*a* and 70*b*. Like the right support member 70*a*, in the left support member 70*b*, the first seating protrusion 71 and the second seating protrusion 72 are alternately disposed parallel to each other in the transverse direction. However, while two first seating protrusions 71 and three second seating protrusions 72 are alternately disposed in the support member 70*a* of FIG. 4A, three first seating protrusions 71 and two second seating protrusions 72 are alternately disposed in the support member 70*b* of FIG. 5. Therefore, at corresponding positions, different types of seating protrusions 71 and 72 are disposed on the support members 70*a* and 70*b*. That is, the first seating protrusion 71 and the second seating protrusion 72 are alternately disposed in a first order on the left support member 70*b* while the first seating protrusion 71 and the second seating protrusion 72 are alternately disposed in a second order on the right support member 70*a*. The first order and the second order are reverse orders. Such arrangements are performed in order to allow a front surface (or a rear surface) of the razor blade 5 to be supported by the first seating protrusion 71 in at least one point of the two support members 70*a* and 70*b*.

FIG. 6A is a cross-sectional view of the razor cartridge 10 of FIG. 1B taken along line A-A' in FIG. 1B. Since a folding position in the blade housing 170 is difficult to clearly distinguish in FIG. 1B due to the seated razor blade 5, the line A-A' is also marked for reference in the blade housing 60 of FIG. 3B.

Referring to FIG. 6A, five razor blades 5*a* to 5*e* are inserted into gaps (seating slots) between first seating protrusions 71 and second seating protrusions 72 which are alternately disposed in the left support member 70*b*. Here, among the illustrated first seating protrusions 71, the first seating protrusions 71 indicated with slashes are those formed in the left support member 70*b*, and the first seating protrusions 71 without slashes are those formed in the right support member 70*a*. The second seating protrusions formed on the right support member 70A are not illustrated since the second seating protrusions are obscured by the first seating protrusions 71 indicated with slashes.

As illustrated in FIG. 6A, it can be seen that at least a portion of a front surface of each of the five razor blades 5*a* to 5*e* is supported by a first seating protrusion 71. Here, each of the razor blades 5*a* to 5*e* is illustrated as the integral blade 51 which is illustrated in FIG. 2A.

Specifically, when each of the razor blades 5*a* to 5*e* include the cutting portion 42, the bent portion 43, and the base portion 44, portions of the cutting portion 42 and the bent portion 43 at the front surfaces of the razor blades 5*a* to 5*e* may be supported by the upper surface 713 or the inclined surface 714 of the first seating protrusion 71. In addition, the base portion 44 may be inserted into the gap (seating slot) between the first seating protrusion 71 and the second seating protrusion 72 and be supported between the first seating protrusion 71 and the second seating protrusion 72. According to various embodiments in which the razor blades 5*a* to 5*e* are seated on the support members 70*a* and 70*b*, various points of the razor blade excluding the cutting edges of the razor blades 5*a* to 5*e* may be supported by the first seating protrusion 71 and the second seating protrusion 72.

Figure 6B:
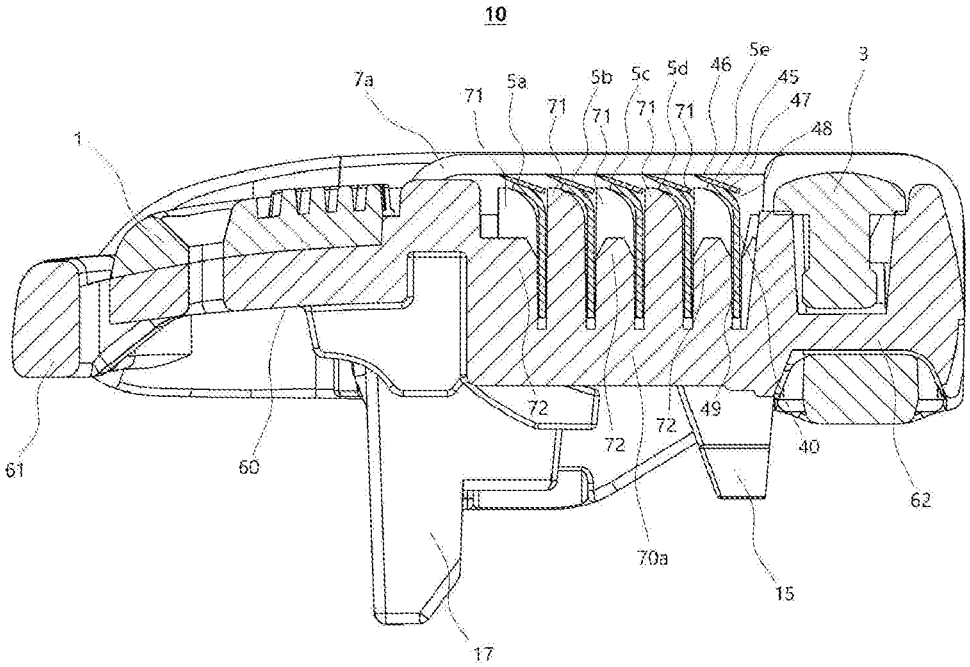
FIG. 6B is a cross-sectional view of the razor cartridge of FIG. 6A in which integrated blades are replaced with large steel blades.

Meanwhile, each of the razor blades 5*a* to 5*e* of FIG. 6A may also be implemented as the large steel blade 52 instead of the integral blade 51. FIG. 6B shows an embodiment in which large steel blades 52 are seated on the support members 70*a* and 70*b* of the blade housing 60.

In this case, each of the razor blades 5*a* to 5*e* may be formed of two members including the cutting portion 45 and the metal support 40. The cutting portion 45 has a cutting edge 46 formed at a front end, and the metal support 40 includes a base portion 49 to be inserted into a seating slot, a blade attaching portion 47 to which the cutting portion 45 is bound, and a bent portion 48 configured to connect the base portion 49 and the blade attaching portion 47.

When the razor blades 5*a* to 5*e* are seated on the support members 70*a* and 70*b*, portions of the blade attaching portion 47 and the bent portion 48 in the front surfaces of the razor blades 5*a* to 5*e* may be supported by the upper surface 713 or the inclined surface 714 of the first seating protrusion 71. In addition, the base portion 49 may be inserted into the gap (seating slot) between the first seating protrusion 71 and the second seating protrusion 72 and be supported between the first seating protrusion 71 and the second seating protrusion 72. Therefore, according to various embodiments in which the razor blades 5*a* to 5*e* are seated on the support members 70*a* and 70*b*, various points of the metal support 40 excluding the cutting portion 45 may be supported by the first seating protrusion 71 and the second seating protrusion 72.

As described with reference to FIGS. 6A and 6B, various points of the razor blades 5*a* to 5*e* excluding the cutting edges may be fixed or supported by the first seating protrusion 71 or the second seating protrusion 43. However, in some cases when seating the razor blades 5*a* to 5*e* on the support members 70*a* and 70*b*, due to assembly characteristics, surface-to-surface contact and support may not necessarily occur between the razor blades 5*a* to 5*e* and the first and second seating protrusions 71 and 72. According to such assembling characteristics, as portions of front surfaces of the blades 5*a* to 5*e* (for example, portions of the cutting portion 42, the bent portion 43, and the base portion 44 in the case of the integral blade 51, and portions of the blade attaching portion 47, the bent portion 48, and the base portion 49 in the case of the large steel blade 52) may be supported by the upper surface 713 or the inclined surface 714 of the first seating protrusion 71, lower ends of rear surfaces of the razor blades 5*a* to 5*e* may be supported upon contact with the second seating protrusion 72 in the vicinity of a lower end of a front surface of the second seating protrusion 72. That is, in some cases the front surfaces of the razor blades 5*a* to 5*e* may be supported by the first seating protrusion 71 at a higher point, and the rear surfaces of the razor blades 5*a* to 5*e* may be supported by the second seating protrusion 72 at a lower point.

Therefore, in some cases regardless of whether the razor blades 5*a* to 5*e* are integral blades 51 or large steel blades 52, since at least a portion of the front surfaces of the razor blades 5*a* to 5*e* excluding the cutting edges are firmly supported by the first seating protrusion 71 and the second seating protrusion 72, a problem of shaking or deformation of the blades 5*a* to 5*e* during shaving may be prevented.

In addition, on the support members 70*a* and 70*b*, portions of the front surfaces and portions of the rear surfaces of the razor blades 5*a* to 5*e* may be respectively supported by the first seating protrusion 71 and the second seating protrusion 72, or conversely, may be respectively supported by the second seating protrusion 72 and the first seating protrusion 71. For example, in the case of a third razor blade 5*c*, a portion of a front surface thereof is supported by the rear surface 722 of the second seating protrusion 72 and a portion of a rear surface thereof is supported by the front surface 711 of the first seating protrusion 71 on the first support member 70*a*. Conversely, on the second support member 70*b*, a portion of the front surface of the third razor blade 5*c* is supported by the rear surface 712, the upper surface 713, or the inclined surface 714 of the first seating protrusion 71 and a portion of the rear surface thereof is supported by the front surface 721 of the second seating protrusion 72. The alternating support patterns of the seating protrusions 71 and 72 with respect to the specific razor blade 5*c* may apply similarly to the other razor blades 5*a*, 5*b*, 5*d*, and 5*e*.

In this way, by differing (alternating) the order of arrangement of the first seating protrusions 71 and the second seating protrusions 72 in different support members 70*a* and 70*b*, the front surfaces of specific razor blades 5*a* to 5*e* may be firmly supported by the first seating protrusion 71 on at least one support member.

Figure 7:
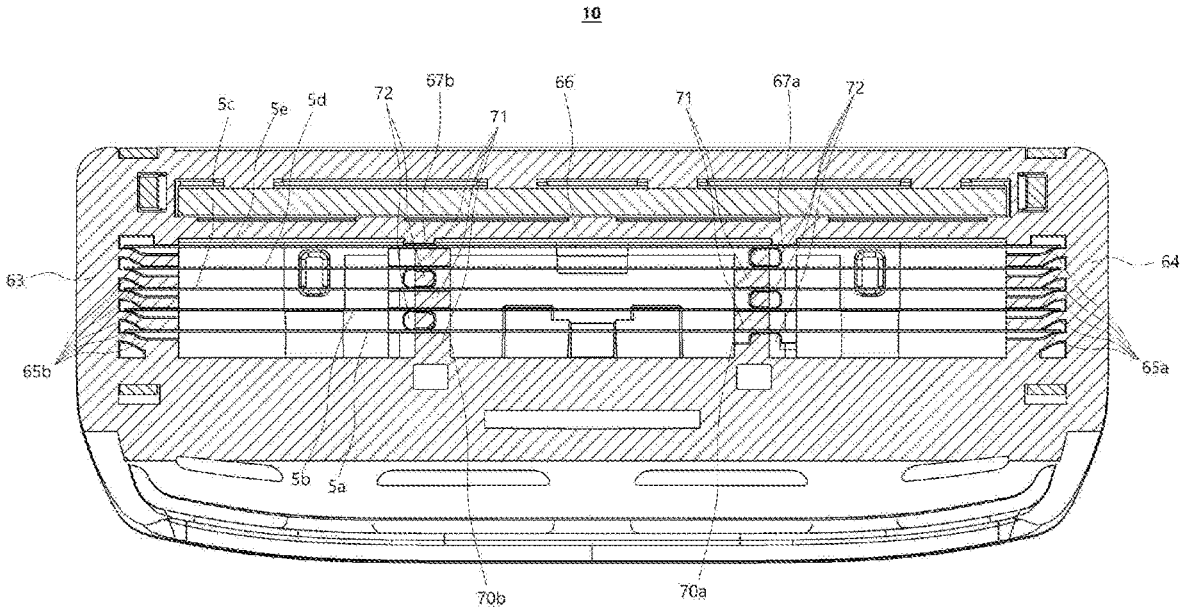
FIG. 7 is a transverse cross-sectional view of the razor cartridge of FIG. 1C taken along line B-B' in FIG. 1C.

FIG. 7 is a transverse cross-sectional view of the razor cartridge 10 of FIG. 1C taken along line B-B' in FIG. 1C.

As described above, the razor blades 5*a* to 5*e* may be stably supported between the first and second seating protrusions 71 and 72. However, a rear surface of the last blade 5*e* may be caused to be directly supported by a rear wall 66 of the blade housing 60 instead of the seating protrusions 71 and 72. This is because, rather than causing the seating protrusions 71 and 72 to be disposed up to the rear position of the last razor blade 5*e*, by causing the rear surface (or a portion of the rear surface) of the last razor blade 5*e* to be directly supported by the rear wall 66 or protrusions 67*a* and 67*b* which slightly protrude forward from the rear wall 66, the structure of the blade housing 60 may be further simplified.

For example, such protrusions 67*a* and 67*b* may be disposed at positions at which the support members 70*a* and 70*b* meet the rear wall 66, but embodiments are not limited thereto. The arrangement positions and the numbers of the protrusions 67*a* and 67*b* may be selected from various choices as necessary.

Meanwhile, it can be seen from FIG. 7 as a whole that the plurality of razor blades 5*a* to 5*e* are supported between the first seating protrusion 71 and the second seating protrusion 72 on the support members 70*a* and 70*b* and are supported by the pressing protrusions 65*a* and 65*b* at the right side portion 64 and the left side portion 63 of the blade housing 60. Therefore, each of the razor blades 5*a* to 5*e* may be supported at a total of four positions along the longitudinal direction. Although the above embodiment has been described by assuming that two support members 70*a* and 70*b* are disposed in the blade housing 60, embodiments are not necessarily limited thereto. In consideration of ease of manufacturing, convenience of assembly, and ease of seating razor blades, and the like, a single support member may be disposed at the center of the blade housing 60 in the transverse direction, or three or more support members may be disposed in the blade housing 60, and in some cases more than one seating protrusion may be disposed on the single support member in the longitudinal direction.

In addition, the pressing protrusions 65*a* and 65*b* formed at the right side portion 64 and the left side portion 63 of the blade housing 60 are illustrated as having forms different from those of the seating protrusions 71 and 72 disposed in the support members 70*a* and 70*b*, but embodiments are not limited thereto. The pressing protrusions 65*a* and 65*b* may also be replaced with the seating protrusions 71 and 72. In this case, all of the support members 70*a* and 70*b* and the right side portion 64 and the left side portion 63 support the razor blades 5*a* to 5*e* by the seating protrusions 71 and 72.

In addition, the number of razor blades may also be selected from various choices. The number of first seating protrusions 71 and second seating protrusions 72 may also be increased or decreased corresponding to the selected number of razor blades.

The structure of the blade housing having a seating protrusion that enhances performance of seating razor blades and is easy to manufacture in a manufacturing process such as injection molding has been described above in relation to the razor cartridge 10 according to an embodiment of the present invention. Hereinafter, a razor cartridge assembly 50 including the razor cartridge 10 and a connector 20 configured to detachably assemble the razor cartridge 10 to the razor handle 30 will be described in detail.

Figure 8A:
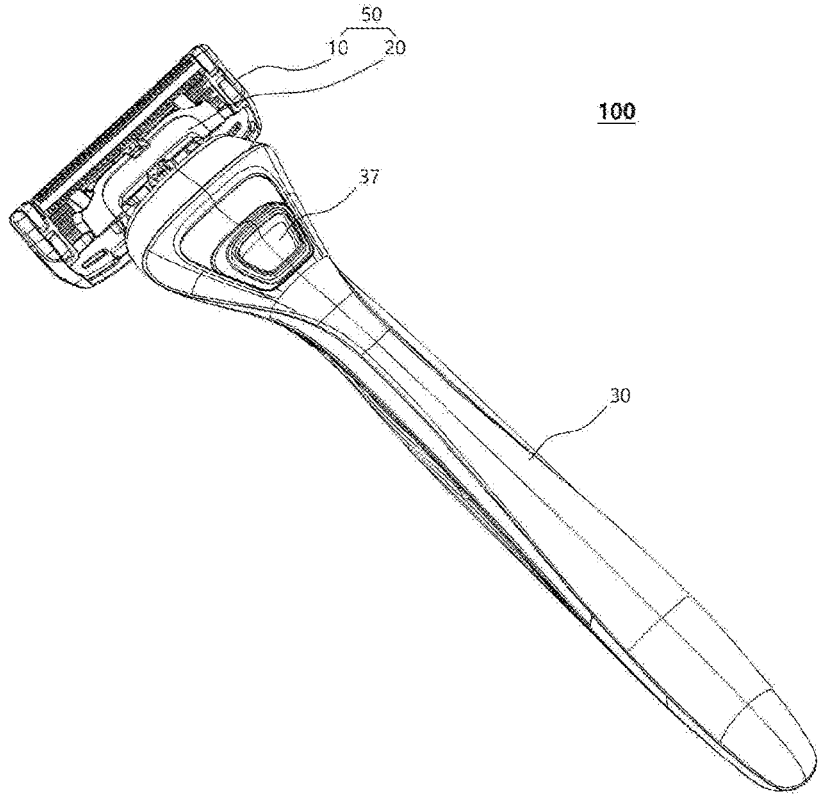
FIG. 8A is a perspective view of a razor according to an embodiment of the present disclosure from a rear surface of a razor handle.
Figure 8B:
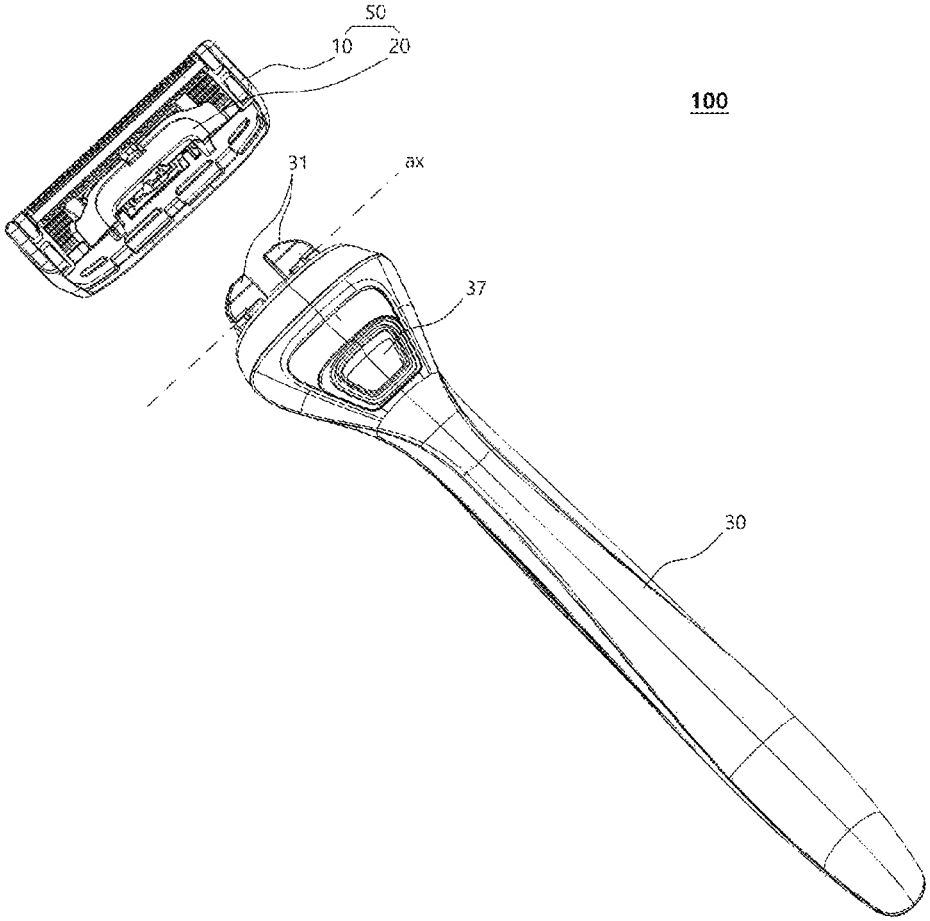
FIG. 8B is a perspective view in which a razor cartridge assembly is separated from the razor handle of FIG. 8A.

FIG. 8A is a perspective view of a razor 100 according to an embodiment of the present disclosure from a rear surface of the razor handle 30 (from a side at which a bottom surface of the razor cartridge 10 is visible), and FIG. 8B is a perspective view in which the razor cartridge assembly 50 is separated from the razor handle 30 of FIG. 8A.

The razor 100 according to the embodiment includes the razor cartridge assembly 50 including the razor cartridge 10 and the connector 20, which is fixed and coupled to the razor cartridge 10, and the razor handle 30, which is detachably coupled to the razor cartridge assembly 50. A pair of plunger guards 31 are formed at an end of the razor handle 30, and the plunger guards 31 may be inserted into or detached from a coupling space included in the razor cartridge assembly 50.

In addition, when removing the plunger guards 31 of the razor handle 30 from the razor cartridge assembly 50, a slider button 37 disposed on a rear surface of the razor handle 30 is pushed toward the razor cartridge assembly 50. In this case, a plunger (not illustrated) which is under elastic bias between the pair of plunger guards 31 protrudes toward one side of the razor cartridge assembly 50 and pushes the one side, and accordingly, the plunger guards 31 are detached from the razor cartridge assembly 50.

Meanwhile, the plunger guards 31 may pivot within a predetermined angle range about a rotation axis ax formed in the vicinity of an end of the razor handle 30. Accordingly, when the plunger guards 31 are coupled to the razor cartridge assembly 50, the razor cartridge assembly 50 may also pivot about the rotation axis "ax."

Figure 9A:
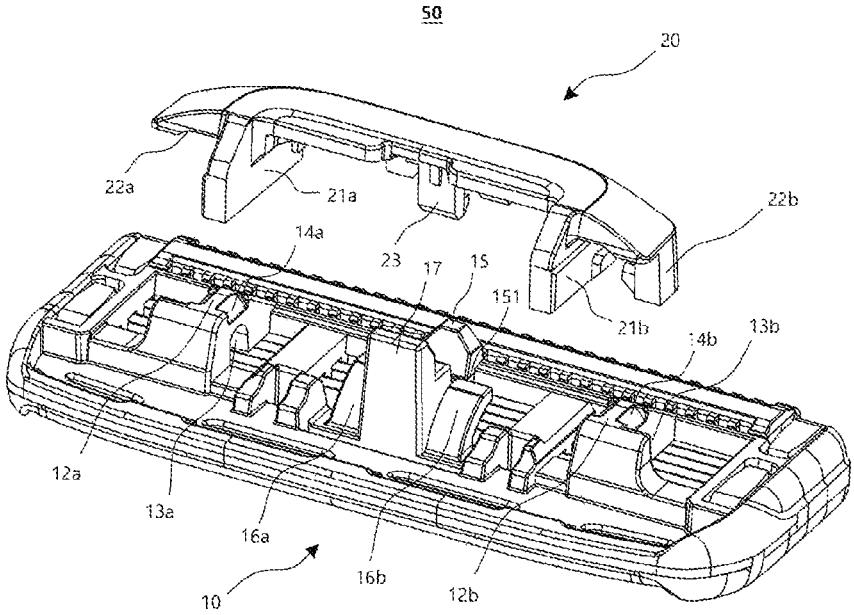
FIGS. 9A and 9B are perspective views in different directions that show the positional relationship between a bottom surface of a razor cartridge and a connector before the two are coupled.
Figure 9B:
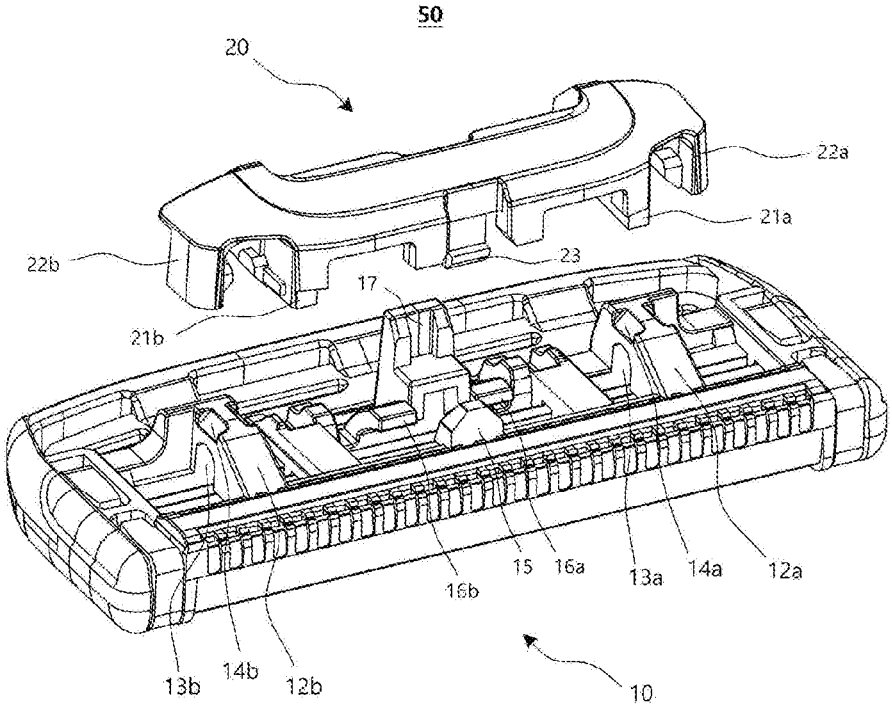

FIGS. 9A and 9B are perspective views in different directions that show the positional relationship between a bottom surface of the razor cartridge 10 and the connector 20 before the two are coupled. When the connector 20 is coupled to the bottom surface of the razor cartridge 10, a combination of inner cantilevers 21*a* and 21*b* and outer cantilevers 22*a* and 22*b* facing the inner cantilevers 21*a* and 21*b* (hereinafter referred to as inner-outer cantilevers) hold the ribs 12*a* and 12*b* from both sides. In addition, an elastic hook 23 is formed between the two pairs of inner-outer cantilevers in the connector 20 and is coupled to a hook coupling portion 15 formed between the pair of ribs 12*a* and 12*b* at the bottom surface of the razor cartridge 10. In this case, due to the inner-outer cantilevers holding the ribs 12*a* and 12*b* from both sides while an end of the elastic hook 23 is locked to a stepped portion 151 formed inside the hook coupling portion 15, the connector 20 and the razor cartridge 10 are firmly coupled to each other.

Figure 10A:
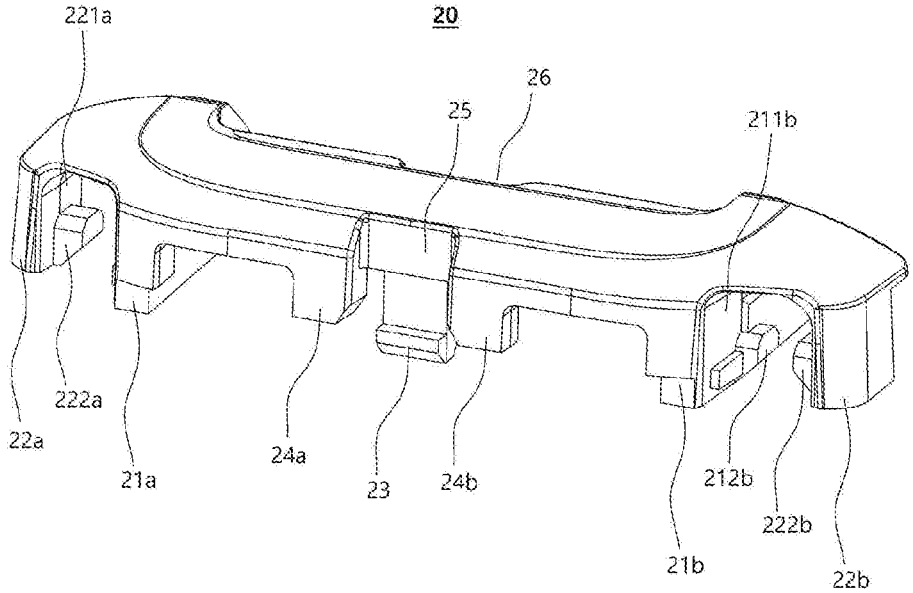
FIGS. 10A, 10B, 10C, and 10D are views for describing a structure of the connector according to an embodiment of the present disclosure in more detail.
Figure 10B:
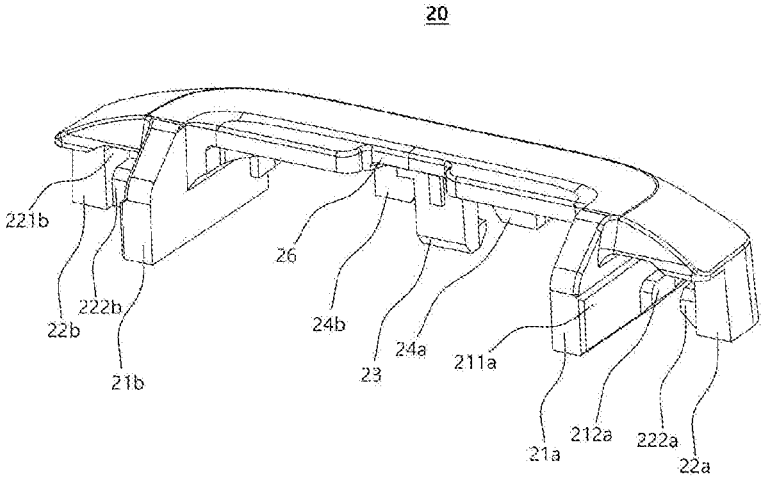
Figure 10C:
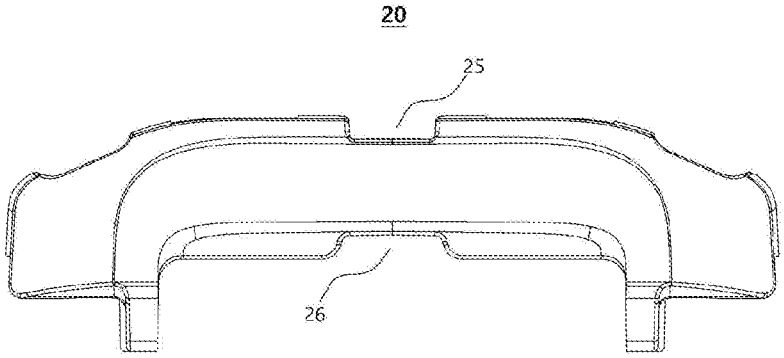
Figure 10D:
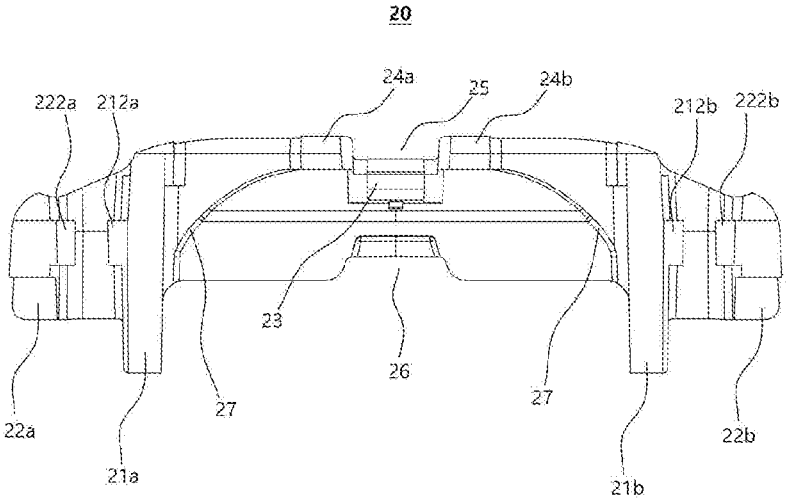

FIGS. 10A to 10D are views for describing a structure of the connector 20 according to an embodiment of the present disclosure in more detail. FIGS. 10A and 10B are perspective views of the connector 20 seen in different directions, and FIGS. 10C and 10D are a plan view and a bottom view, respectively, of the connector 20.

During assembly between the connector 20 and the razor cartridge 10, first, the inner-outer cantilevers 21*a* and 22*a* or 21*b* and 22*b* formed at left and right sides of the connector 20 are engaged to hold the ribs 12*a* and 12*b* formed at corresponding positions of the razor cartridge 10. The connector 20 and the razor cartridge 10 may be firmly assembled just by the above engagement. However, a fine clearance may be generated due to assembly tolerance. Therefore, in an embodiment of the present disclosure, the connector 20 may further include the elastic hook 23 that is able to be coupled to the hook coupling portion 15 of the razor cartridge 10 at a position corresponding to the hook coupling portion 15. In this case, since an end of the elastic hook 23 that may be bent by a cantilever beam structure is locked to the stepped portion 151 formed inside the hook coupling portion 15, the clearance problem can be effectively solved, and firmer coupling may be guaranteed between the connector 20 and the razor cartridge 10.

In addition, the connector 20 may include a pair of step portions 24*a* and 24*b* that are formed near the elastic hook 23 and are configured to guide the hook coupling portion 15 so that the elastic hook 23 and the hook coupling portion 15 are coupled to each other at correct positions. The stepped portions 24*a* and 24*b* may have vertically symmetrical shapes with respect to the elastic hook 23, and a guide slot 25, which is a space in which the hook coupling portion 15 may move while being guided, is formed between the two stepped portions 24*a* and 24*b*.

Meanwhile, at the opposite side of the guide slot 25, a clearance groove 26, which is disposed at a predetermined interval y from the central bar 17 of the razor cartridge 10 during assembly of the razor cartridge 10 and the connector 20, is formed. When the plunger (not illustrated) of the razor handle 30 protrudes, the central bar 17 is pushed while being elastically deformed to some extent in a direction opposite from the plunger. In this case, the clearance groove 26 provides a space in which the pushed central bar 17 may be bent while having slight elasticity.

Meanwhile, referring to FIG. 10D, a recess portion 27 which is substantially arc shape is formed in an inner surface of the connector 20. The recess portion 27 has a profile that matches an outer shape of the pair of plunger guards 31 (see FIGS. 12A to 12C) formed at a proximal end of the razor handle 30.

Figure 11:
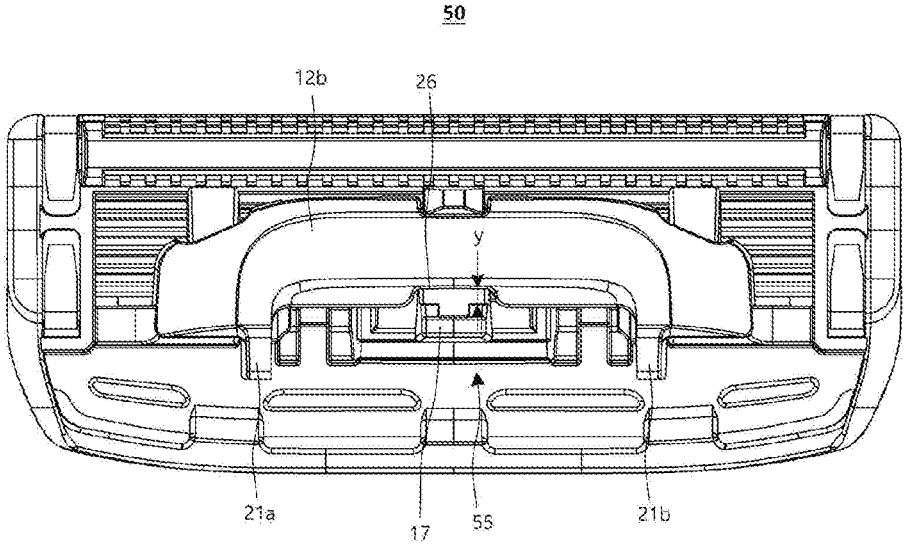
FIG. 11 is a bottom view of a razor cartridge assembly according to an embodiment of the present disclosure.

FIG. 11 is a bottom view of an assembly of the connector 20 and the razor cartridge 10, that is, the razor cartridge assembly 50.

While the razor cartridge 10 and the connector 20 are assembled as described above, an engagement space 55 into which the proximal end of the razor handle 30 may be inserted toward the front end of the razor cartridge 10 is formed between the razor cartridge 10 and the connector 20. In this case, the inner cantilevers 21*a* and 21*b* form both ends of the engagement space 55 in a transverse direction d. In addition, the engagement space 55 is divided into two areas by the central bar 17 of the razor cartridge 10, and the pair of plunger guards 31 may be respectively inserted into the two areas.

When causing the razor handle 30 to be separated from the razor cartridge assembly 50 in the above-described assembly state, the plunger (not illustrated) of the razor handle 30 protrudes due to a user's manipulation. Therefore, the plunger pushes the central bar 17, and the pair of plunger guards 31 retreat from the engagement space 55 and are separated therefrom. In this case, the central bar 17 that is pushed by the plunger may be bent within a predetermined interval y range while having slight elasticity.

Figure 12A:
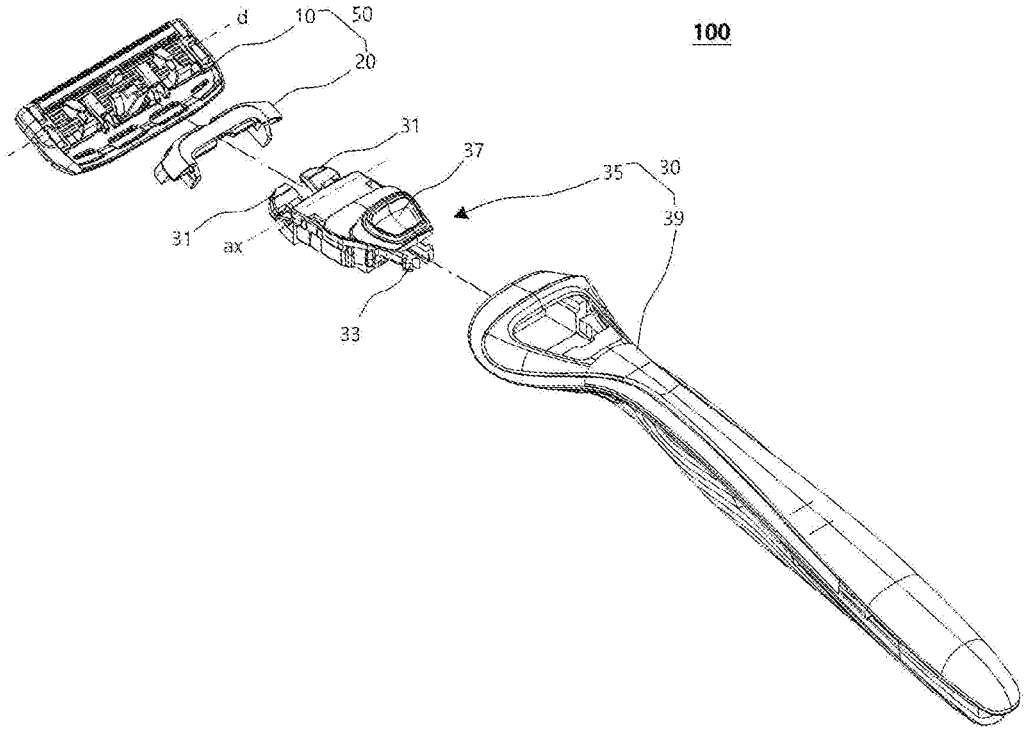
FIG. 12A is an exploded perspective view of a razor according to an embodiment of the present disclosure.
Figure 12B:
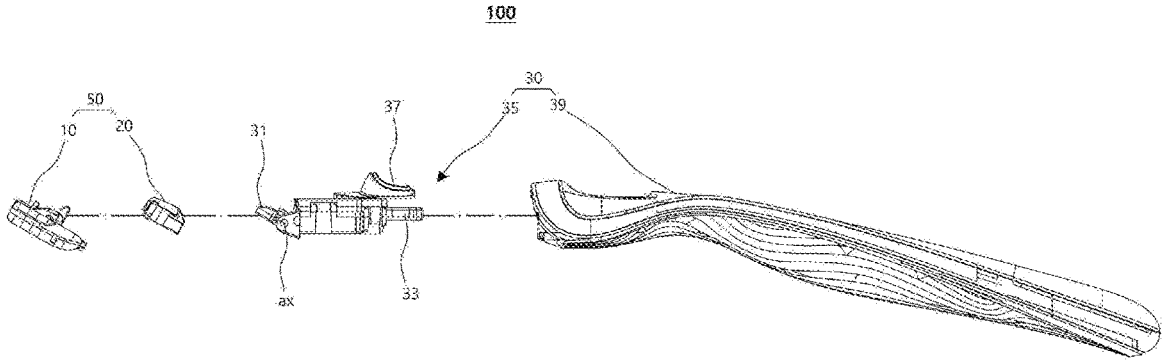
FIG. 12B is a side view of the exploded perspective view of FIG. 12A, and 12C is a plan view of the exploded perspective view of FIG. 12A.
Figure 12C:
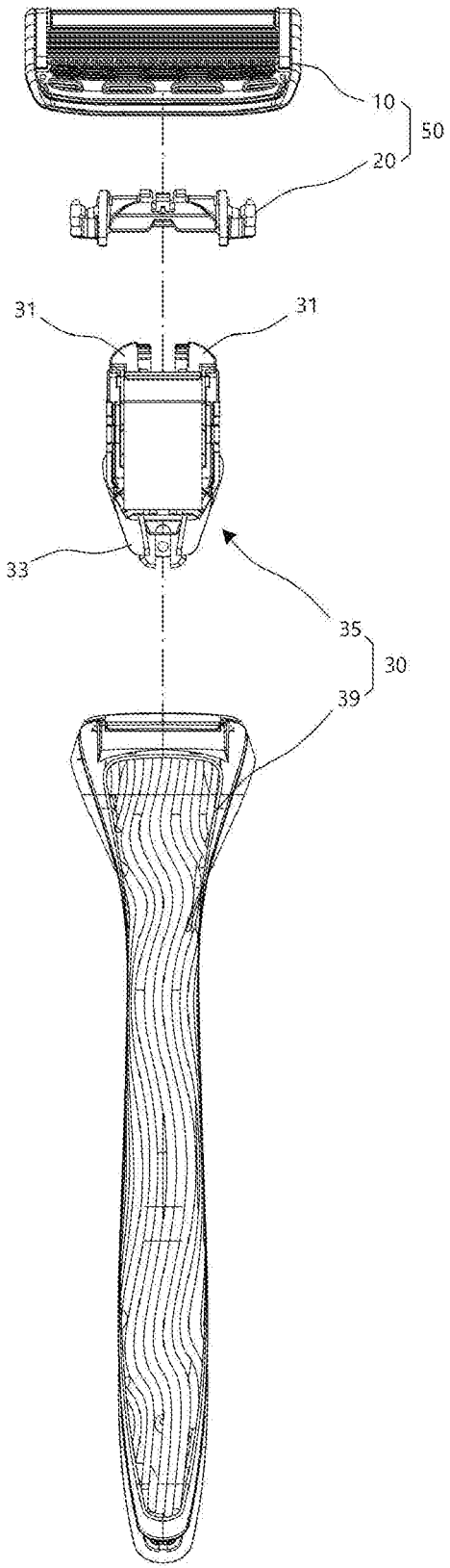

FIG. 12A is an exploded perspective view of the razor 100 according to an embodiment of the present disclosure, FIG. 12B is a side view of the exploded perspective view of FIG. 12A, and 12C is a plan view of the exploded perspective view of FIG. 12A.

As described above, after the razor cartridge 10 and the connector 20 are assembled such that the razor cartridge assembly 50 is formed, the pair of plunger guards 31 may be detachably coupled to the engagement space 55 formed in the razor cartridge assembly 50. The engagement space 55 may be divided into two areas by the central bar 17, and the pair of plunger guards 31 may be respectively inserted into the two areas. That is, when the pair of plunger guards 31 are inserted into the engagement space 55, the central bar 17 supports a space between the pair of plunger guards 31.

The plunger guards 31 may be disposed at a proximal end side of a cartridge mounter 35 that is separately disposed to be able to be coupled to a handle grip 39, and the plunger guards 31 may pivot within a predetermined angle range about the rotation axis ax that is parallel with the transverse direction d of the razor. Therefore, while shaving is performed, the razor cartridge assembly 50 which is coupled to the plunger guards 31 may also pivot about the rotation axis ax according to a user's manipulation. A coupling member 33 is formed at a distal end side of the cartridge mounter 35 so that the cartridge mounter 35 may be coupled to a proximal end side of the handle grip 39. Of course, unlike the above, the cartridge mounter 35 may also be integrally formed with the handle grip 39 instead of being manufactured as a separate element and coupled to the handle grip 39.

Meanwhile, the slider button 37 is formed at one side of the cartridge mounter 35. The user may cause the plunger (not illustrated) to protrude by pushing the slider button 37 upward toward the razor cartridge assembly 50. As illustrated in FIG. 12A, the pair of plunger guards 31 are disposed at the proximal end of the cartridge mounter 35, and a plunger is formed to be inserted or withdrawn between the pair of plunger guards 31. In this case, the plunger is at a position at which it does not protrude to the outside when there is no external force, and then when the user pushes the slider button 37 upward toward the razor cartridge assembly 50, the plunger protrudes toward the razor cartridge assembly 50 from between the two plunger guards 31. Due to the plunger, which protrudes as above, pushing the central bar 17 (see FIG. 9B), the plunger guards 31, which have been coupled to the engagement space 55, are detached from the razor cartridge assembly 50.

According to the razor cartridge according to the present disclosure, seating protrusions are disposed in a row to stably support blades on a blade housing while the seating protrusions are disposed at different heights. In this way, there is an advantage in that, while injection of the blade housing including the seating protrusions is facilitated, the blades are stably supported on the blade housing.

According to the razor cartridge according to the present disclosure, the order of arrangement of seating protrusions of a first support member and the order of arrangement of seating protrusions of a second support member are set to be different. In this way, there is an advantage in that, on at least one side, a plurality of blades can be supported by seating protrusions having a high height.

According to the razor cartridge assembly according to the present disclosure, since inner and outer cantilevers expand and deform at both sides of a rib, which is formed at a bottom surface of a blade housing, and hold the rib, there is an advantage in that assembling can be firmly and conveniently performed.

Embodiments of the present disclosure have been described above with reference to the accompanying drawings, but those of ordinary skill in the art to which the present disclosure pertains should understand that the present disclosure may be practiced in other specific forms without changing the technical idea or essential features thereof. Therefore, the embodiments described above are illustrative in all aspects and should not be understood as limiting.

What is claimed is:

1. A razor cartridge comprising:

a plurality of razor blades, each razor blade having a cutting edge;

a blade housing configured to accommodate the plurality of razor blades;

at least one support member disposed in a frame of the blade housing comprising a front portion, a rear portion opposite the front portion, and two side portions connecting the front portion and the rear portion;

a plurality of seating protrusions disposed on the at least one support member;

a guard disposed at the front portion of the frame of the blade housing; and a cap disposed at the rear portion of the frame of the blade housing, wherein:

the at least one support member is extended in a direction transverse to the cutting edges of the plurality of razor blades between the front portion and the rear portion of the frame of the blade housing such that the front portion and the rear portion of the frame of the blade housing are connected by the at least one support member disposed between the front portion and the rear portion of the frame of the blade housing;

the plurality of seating protrusions are configured to seat the plurality of razor blades;

the plurality of seating protrusions are spaced apart from each other;

the plurality of seating protrusions include a first seating protrusion having a first height and a second seating protrusion having a second height lower than the first height;

the first and second seating protrusions protrude from a same surface of the at least one support member such that a base of the first seating protrusion and a base of the second seating protrusion have a same baseline that is parallel to a bottom surface of the at least one support member exposed at a bottom side of the blade housing;

the first height corresponds to a length between the baseline and a distal end of the first seating protrusion;

the second height corresponds to a length between the baseline and a distal end of the second seating protrusion; and the cutting edge of the razor blade, which is inserted into a seating slot formed between the first seating protrusion and the second seating protrusion, extends past the distal ends of the first and second seating protrusions.

2. The razor cartridge of claim 1, wherein:

the plurality of seating protrusions comprise a plurality of first seating protrusions and a plurality of second seating protrusions; and the plurality of first seating protrusions and the plurality of second seating protrusions are alternately disposed on the support member such that all of the plurality of first seating protrusions have the first height and all of the plurality of second seating protrusions have the second height.

3. The razor cartridge of claim 2, wherein each of the at least one razor blade is seated between a corresponding one of the plurality of first seating protrusions and a corresponding one of the plurality of second seating protrusions.

4. The razor cartridge of claim 2, wherein the first seating protrusion has a first width in a longitudinal direction in which the at least one razor blade is seated, and the second seating protrusion has a second width in the longitudinal direction narrower than the first width.

5. The razor cartridge of claim 4, wherein the first seating protrusion and the second seating protrusion are disposed to be parallel on the at least one support member.

6. The razor cartridge of claim 2, wherein the first seating protrusion includes an upper surface and a rear surface, and the upper surface or rear surface is configured to support at least a portion of a front surface of the at least one razor blade.

7. The razor cartridge of claim 6, wherein the first seating protrusion further includes an inclined surface between the upper surface and the rear surface and configured to support at least a portion of the front surface of the at least one razor blade.

8. The razor cartridge of claim 2, wherein:

the first seating protrusion includes an upper surface, a rear surface, and an inclined surface between the upper surface and the rear surface;

the at least one razor blade is an integral blade including a cutting portion having a cutting edge, a base portion, and a bent portion between the cutting portion and the bent portion; and the upper surface or the inclined surface of the first seating protrusion is configured to support at least a portion of a front surface of the cutting portion or a front surface of the bent portion.

9. The razor cartridge of claim 2, wherein:

the first seating protrusion includes an upper surface, a rear surface, and an inclined surface between the upper surface and the rear surface;

the at least one razor blade is a steel blade including a cutting portion having a cutting edge and a metal support that is coupled to the cutting portion and configured to support the cutting portion;

the metal support includes a base portion, a blade attaching portion coupled to the cutting portion, and a bent portion between the base portion and the blade attaching portion; and the upper surface or the inclined surface of the first seating protrusion is configured to support at least a portion of a front surface of the blade attaching portion or a front surface of the bent portion.

10. The razor cartridge of claim 5, wherein a tapered surface is formed at an upper portion of the second seating protrusion and is configured to facilitate insertion of the at least one razor blade.

11. The razor cartridge of claim 5, wherein a first groove is formed at a corner of an upper end of the first seating protrusion.

12. The razor cartridge of claim 11, wherein a second groove is formed at a corner of an upper end of the second seating protrusion.

13. The razor cartridge of claim 12, wherein profiles of the first and second grooves match.

14. The razor cartridge of claim 12, wherein:

the first groove is formed at the corner that faces an outer side of the blade housing; and the second groove is formed at the corner that faces the outer side of the blade housing.

15. The razor cartridge of claim 1, wherein:

the at least one support member includes a first support member configured to support the blade housing at one side of the blade housing and a second support member configured to support the blade housing at another side of the blade housing; and the plurality of seating protrusions include a plurality of first seating protrusions and a plurality of second seating protrusions disposed on each of the first support member and the second support member.

16. The razor cartridge of claim 15, wherein:

the plurality of first seating protrusions and the plurality of second seating protrusions are alternately disposed in a first order on the first support member;

the plurality of first seating protrusions and the plurality of second seating protrusions are alternately disposed in a second order on the second support member; and the first order and the second order are reverse orders.

17. The razor cartridge of claim 16, wherein a front surface of the at least one razor blade is supported by one of the plurality of first seating protrusions on at least one point of the at least one razor blade.

18. The razor cartridge of claim 17, wherein a rear surface of the at least one razor blade is supported by one of the plurality of second seating protrusions on at least one point of the at least one razor blade.

19. The razor cartridge of claim 18, further comprising a plurality of pressing protrusions configured to support both ends of the at least one razor blade and disposed to be parallel at a left side portion and a right side portion of the blade housing.

20. A razor cartridge assembly comprising:

a plurality of razor blades, each razor blade having a cutting edge;

a blade housing configured to accommodate the plurality of razor blades;

at least one support member disposed in a frame of the blade housing comprising a front portion, a rear portion opposite the front portion, and two side portions connecting the front portion and the rear portion;

a plurality of seating protrusions disposed on the at least one support member; and a connector coupled to the blade housing at a bottom side of the blade housing and configured to be detachable from a razor handle, wherein:

the at least one support member is extended in a direction transverse to the cutting edges of the plurality of razor blades between the front portion and the rear portion of the frame of the blade housing such that the front portion and the rear portion of the frame of the blade housing are connected by the at least one support member disposed between the front portion and the rear portion of the frame of the blade housing;

the plurality of seating protrusions are configured to seat the plurality of razor blades;

the plurality of seating protrusions are spaced apart from each other;

the plurality of seating protrusions include a first seating protrusion having a first height and a second seating protrusion having a second height lower than the first height;

the first and second seating protrusions protrude from a same surface of the at least one support member such that a base of the first seating protrusion and a base of the second seating protrusion have a same baseline that is parallel to a bottom surface of the at least one support member exposed at the bottom side of the blade housing;

the first height corresponds to a length between the baseline and a distal end of the first seating protrusion;

the second height corresponds to a length between the baseline and a distal end of the second seating protrusion; and the cutting edge of the razor blade, which is inserted into a seating slot formed between the first seating protrusion and the second seating protrusion, extends past the distal ends of the first and second seating protrusions.

21. The razor cartridge assembly of claim 20, wherein:

the blade housing further includes a pair of ribs configured to support the blade housing at the bottom side of the blade housing;

the connector includes an inner cantilever and an outer cantilever that faces the inner cantilever in a direction in which the at least one razor blade is accommodated; and one of the pair of ribs is secured between the inner cantilever and the outer cantilever to couple the blade housing and the connector.

* * * * *